US006237180B1

(12) United States Patent
Viego

(10) Patent No.: US 6,237,180 B1
(45) Date of Patent: May 29, 2001

(54) DEVICE FOR EXTENDING THE EFFECTIVENESS AND LIFE OF ELECTRIC TOOTHBRUSH HEADS

(76) Inventor: Virginia Serafina Viego, 711 Fairlawn Ave., Libertyville, IL (US) 60048

( * ) Notice: Subject to any disclaimer, the term of this patent is extended or adjusted under 35 U.S.C. 154(b) by 0 days.

(21) Appl. No.: 09/345,352

(22) Filed: Jul. 1, 1999

(51) Int. Cl.[7] ..... A46B 17/00

(52) U.S. Cl. ..... 15/28; 15/257.01; D4/102; D4/108; 206/361; 206/362.2; 206/362.3

(58) Field of Search ..... 15/257.01, 28, 15/29, DIG. 4, 175; D4/102, 108, 113; 206/361, 362.2, 362.3; 141/331, 332, 340–343; D7/700

(56) References Cited

U.S. PATENT DOCUMENTS

D. 404,979 * 2/1999 Harman et al. ..... D7/700
1,359,650 * 11/1920 Amis .
2,580,811 * 1/1952 Martinsen .
2,633,236 * 3/1953 Hempel .
2,797,886 * 7/1957 Pinckney .
2,897,531 * 8/1959 Calabrese .
2,947,412 * 8/1960 Tupper .
3,603,358 * 9/1971 Mallindine ..... 141/343
4,884,311 * 12/1989 Gergory ..... 15/167.1
5,042,107 * 8/1991 Gregory ..... 15/167.1

* cited by examiner

*Primary Examiner*—Gary K. Graham

(57) ABSTRACT

A dental oral hygiene device for extending the useful lifetime of replaceable electric or battery operated toothbrush heads having a stem attached to a handle on one end and to a rotating disk at the other end, whose center of rotation is perpendicular to the stem, with a plurality of bristles attached to it. The bristles having a defined length are attached to the disk surface in a round array perpendicular to the stem. Each of the bristles having a proximal end attached to the disk surface and a distal end forming a tip. The device forces the bristles into proper alignment by applying pressure to the bristles along the bristle length, approximately from the bristle tip to a point between the bristle tip and the proximal end of the bristle. The bristles are forced generally inwardly by the device such that the round array is generally maintained and the bristles are prevented from splaying outwardly.

1 Claim, 2 Drawing Sheets

DEVICE FOR EXTENDING THE EFFECTIVENESS AND LIFE OF ELECTRIC TOOTHBRUSH HEADS

CROSS-REFERENCE TO RELATED APPLICATIONS

U.S. Patent Documents:

| | | | |
|---|---|---|---|
| 1960807 | May., 1934 | Cole | 15/185. |
| 2608293 | Aug., 1952 | Carlson | 15/185. |
| 2620500 | Dec., 1952 | Ridner, Sr. | 15/184. |
| 2897531 | Aug., 1959 | Calabrese | 15/257. |
| 2947412 | Aug., 1960 | Tupper | 15/184. |
| 3120019 | Feb., 1964 | Scott | 15/184. |
| 3127985 | Apr., 1964 | Scott | 15/184. |
| 3665563 | May., 1972 | Batts | 24/543. |
| 4237579 | Dec., 1980 | Salmon | 15/246. |
| 4884311 | Dec., 1989 | Gregory | 15/167. |
| 5042107 | Aug., 1991 | Gregory et al. | 15/257. |
| 5315733 | May., 1994 | Ledingham | 15/168. |
| 5509168 | Apr., 1996 | Butler et al. | 15/257.01 |

STATEMENT REGARDING FEDERALLY SPONSORED RESEARCH OR DEVELOPMENT

This patent application is not the result of a federally sponsored research or development initiative.

REFERENCE TO A MICROFICHE APPENDIX

Not applicable.

BACKGROUND OF THE INVENTION

1. Field of the Invention

The present invention relates generally to the field of oral hygiene and more specifically to a device that places pressure on the bristles of a circular toothbrush head such that the device aligns and straightens the bristles to reverse and prevent splaying, such that the toothbrush head is effective and useful for a longer period of time.

2. Description of Prior Art

In the daily practice of oral hygiene over extended periods of time, the bristles of a toothbrush head becomes deformed such that the bristle ends splay in various directions. Also, over time, the toothbrush head becomes increasingly unsatisfactory to use as the toothbrush head bristles do not present a united front to the area to be brushed. As the bristles deform and splay, the toothbrush head loses a measure of effectiveness in cleaning the teeth and gums, and irritation and ulcers may result to the mouth's soft gum tissue. New toothbrush heads can become significantly splayed in a short time. However, most people continue to use their toothbrush head long after its original shape has been altered by use and its effectiveness diminished. Because toothbrush head bristles are made of thin plastic material, subject to bending, splaying bristles is a normal occurrence.

Various devices have been developed to attempt to protect and/or shape the bristles of a toothbrush. None of the prior art has been found to meet the specific needs to which the present invention is directed. For example, U.S. Pat. No. 1,960,807 to Cole discloses a toothbrush with an integrated retractable hood to cover the toothbrush head to protect it from contamination. U.S. Pat. No. 2,608,293 to Carlson also discloses a toothbrush with an attached slidable protective casing for the toothbrush head to protect it from contamination. Neither of these two inventions were developed to act upon the bristles in a positive manner.

Other devices have been developed to attempt to maintain the toothbrush bristles in an upright position when in use. U.S. Pat. No. 2,620,500 to Ridner, Sr. discloses a combination toothbrush and protective case having upright walls forcing the bristles of the enclosed toothbrush to remain upright. U.S. Pat. No. 3,120,019 to Scott discloses a combination toothbrush clamp and cover, also having upright walls that close over the toothbrush bristles, forcing them into an upright position. U.S. Pat. No. 3,127,985 to Scott discloses a protective case for the head of a toothbrush, having walls which angle slightly inward at their tops to act on the splayed bristle tips. All these inventions were developed for toothbrush heads with rectangular bristles array patterns and they do not apply to circular bristles array pattern.

Still other devices have been developed to positively act on the toothbrush bristles. U.S. Pat. No. 2,897,531 to Calabrese discloses a sleeve like clamp to position the toothbrush bristles while drying. U.S. Pat. No. 2,947,412 to Tupper follow similar design considerations. While the Calabrese and Tupper devices may force the bristles slightly inwardly in a rectangular bristles array pattern, they do not have a suitable structure for aligning the bristles of a circular bristles arrangement. In effect, the Calabrese and Tupper device is supposed to be slipped over the end of a rectangular brush pattern and this could not be done over a circular brush pattern.

U.S. Pat. No. 4,884,311 to Gregory discloses a spring clamp for reforming toothbrush bristles. The clamp is positioned at a preselected height down from the free ends, or tips, of the bristles such that the bristles are reformed to flare outward so that they can scour trader the gum flap. The clamp's desired intention is to alter the configuration of the bristles such that the bristles flare outward instead of forming in a vertical position, as manufactured. In addition, the resulting bristle shape is not applicable to a circular brush.

U.S. Pat. No. 5,042,107 to Gregory, et al., a continuation, discloses a cover with compression means to reform toothbrush bristles. Again, the clamp is positioned at a preselected height down from the free ends, or tips, of the bristles such that the bristles are reformed to flare outward so that they can scour under the gum flap. The clamp's desired intention also is to alter the configuration of the bristles such that the bristles flare outward instead of forming in a vertical position, as manufactured and it is not applicable to a circular brush.

U.S. Pat. No. 5,509,168 too is a clamping device specifically designed for toothbrushes with rectangular brush patterns and it is not appropriate for brushes with circular design.

Although the prior art discloses various devices to cover and reposition toothbrush bristles, none discloses a device which applies pressure to a circular designed brush. Some of the patents provide only a storage case for the toothbrush not addressing the needs for realigning the bristles. Some others try to change the manufacturer's bristles design by realigning the bristles, instead of maintaining the effectiveness of the toothbrush by maintaining the bristles in its original alignment and shape. Thus, it can be seen that there is a need for a device for extending the useful life and effectiveness of toothbrushes with circular bristle array pattern which maintains the toothbrush bristles in as close to the as-new shape as possible.

BRIEF SUMMARY OF THE INVENTION

The present invention is a hollow truncated cone device with a hollow cylindrical extension at the truncated end of the cone. The diameter of the base of the cone is large enough and hollow to receive the miss aligned bristles of a worn round toothbrush head. As the bristles are pushed up the base of the hollow truncated cone, pressure is uniformly produced by the inside surface of the cone all around the toothbrush bristles. This pressure forces the miss-aligned bristles into proper alignment and after that the inside surface of the cylindrical extension will keep them properly aligned.

When this device is inserted on a wet toothbrush head and left for a few hours to dry, such as, after brushing the teeth, the bristles remain properly aligned after removing the device. When a major realignment of the toothbrush bristles is required they can be heated up and allowed to cool down with the device in place. This can easily be accomplished by dropping the removable toothbrush head with the device holding the bristles in proper alignment, in a cup of hot water and letting it cool down. The hot water slightly softens the bristle material and allows the molecules to realign to the original shape. After the bristles cool down and the device is removed, they remain properly aligned.

It is an object of the present invention to provide a device which reverses the splaying of toothbrush bristles caused by use.

It is another object of the present invention to provide a device which increases the useful life and effectiveness of a toothbrush.

Yet another object of the present invention is to provide a device which reshapes and realigns the splayed bristles of a used toothbrush head to a shape and alignment similar to a new toothbrush.

A further object of the present invention is to provide a device which could be used in combination with a toothbrush case or holder to stores the toothbrush heads while at the same time reshapes and realigns the splayed bristles of a used toothbrush.

Still another object of the present invention is to provide a device which prevents the splaying of the bristles of a toothbrush.

These objects, and other objects, features and advantages of the present invention, will become more apparent to one skilled in the art when the following detailed description of the preferred embodiments is read in conjunction with the appended drawings, in which like reference numerals designate like parts throughout the several views.

DETAILED DESCRIPTION OF THE INVENTION

The present invention is a device that places pressure on the bristles of a toothbrush to align and straighten the toothbrush bristles and to prevent the splaying which has a tendency to occur after brushing briskly and over a period of time. Splaying of the toothbrush bristles can cause irritation and ulcers. The device, which fits around the bristles of the replaceable head of an electric toothbrush, allows the toothbrush heads to last longer by retaining the bristles shape and to be more effective for the life of the head. The device also keeps the brush from resting directly on a surfaces to prevent contamination of both the toothbrush bristles and the surface.

Figure 1:
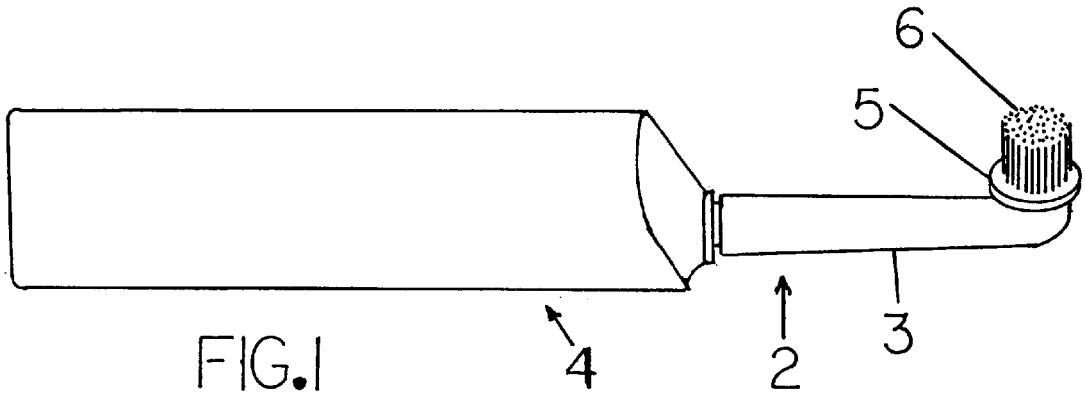
FIG. 1 is a perspective side view of an electric toothbrush depicting the handle and the head.

FIG. 1 A battery operated toothbrush with a replaceable toothbrush head 2 having a stem 3 attached to a handle 4 on one end and to a rotating disk 5 at the other end whose center of rotation is perpendicular to the stem 3. The rotating disk 5 has an elongated plurality of bristles 6 each having a defined length attached generally perpendicular to the longitudinal axis of the stem 3 forming a generally circular bristle array.

Figure 2:
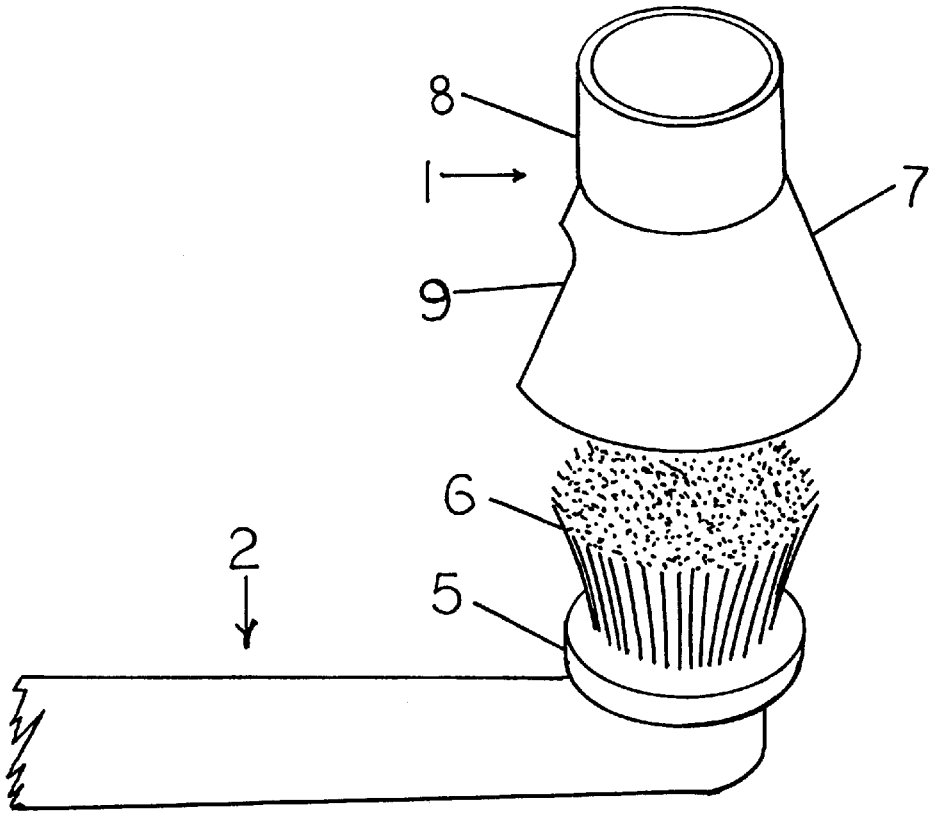
FIG. 2 is a perspective side view of the device illustrated with a partial toothbrush head with bristles about to be inserted in the device.
Figure 4:
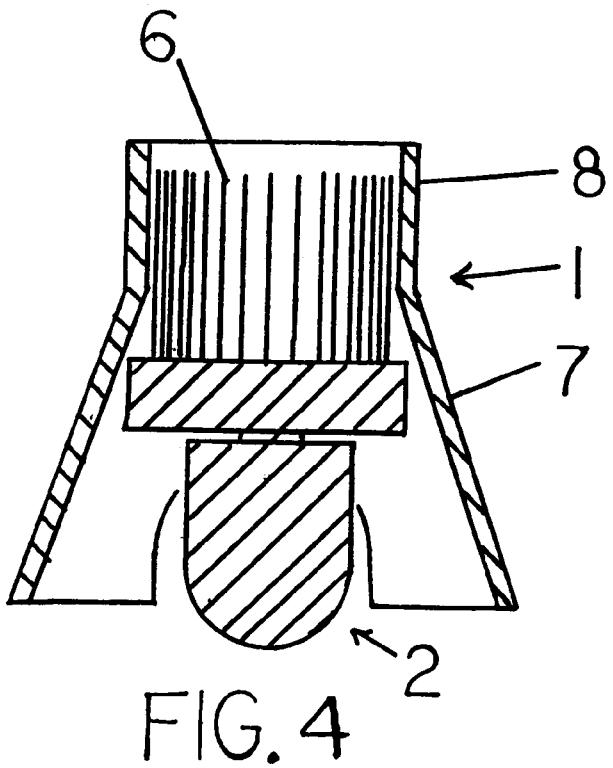
FIG. 4 is a sectional side view of the device depicted in FIG. 3 along line 4'—4'. It is illustrated with the toothbrush bristles inserted in the device.

Referring now to FIGS. 2 and 4; The embodiment of the device 1 covered by the present invention is a hollow truncated cone 7 with a hollow cylindrical extension 8 at the truncated end of the cone. The diameter of the base of the cone 7 is large enough and hollow to receive the miss-aligned bristles 6 of a worn round toothbrush head 2. As the bristles are pushed further up the base of the hollow truncated cone, pressure is produced all around the toothbrush bristles circular pattern produced by the internal wall of cone 7. This pressure reverses splaying and aligns the bristles to proper alignment.

The pressure created is designed to effect histeresis in the splayed bristles 6. The pressure maintained by the internal surface of the cylindrical extension 8 assures that the toothbrush bristles 6 are held in place from approximately the midpoint to the tip of the bristles farthest from the bristles base 5. A cutout 9 on one side of the cone 7 prevents the stem from interfering with properly setting the device.

Figure 3:
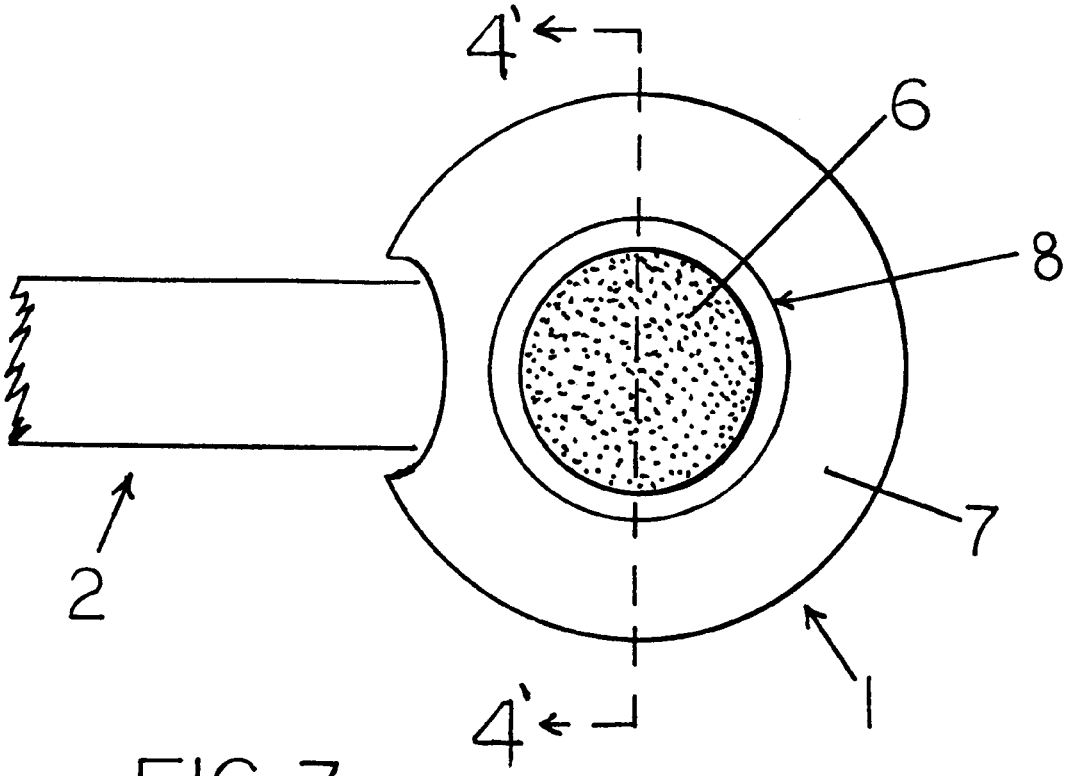
FIG. 3 is a top view of the device depicted in FIG. 2.

FIG. 3 Top view of the device 1 showing dotted lines 4'—4' of a section depicted on FIG. 4.

When this device is inserted on a wet toothbrush head and left for a few hours to dry, such as, after brushing the teeth, the bristles remain properly aligned after removing the device. When a major realignment of the toothbrush bristles is required they can be heated up and allowed to cool down with the device in place. This can easily be accomplished by dropping the removable toothbrush head, with the device holding the bristles in proper alignment, in a cup of hot water and letting it cool down. The hot water slightly softens the bristles material and allows the molecules to realign to the original shape. After the bristles cool down and the device is removed, they remain properly aligned.

The internal surfaces of the devise could be smooth or with many grooves parallel to the bristles to facilitate their proper alignment.

The preferred embodiment described above are for illustrative purposes only and are not intended to limit the scope of the invention or its equivalents, as defined in the appended claims

What is claimed is:

1. An electric toothbrush having a handle, an elongated stem attached at a first end thereof to said handle and rotatably supporting at a second end thereof a disk, said disk supports a circular array of bristles, said toothbrush includes a detachable bristle aligning device for extending the useful lifetime of said bristles, said bristle aligning device comprises a truncated conical portion and a cylindrical portion, said conical portion having, relatively, large and small diameter ends and said cylindrical portion attached to said small diameter end of said conical portion, said conical portion has a cutout extending from the large diameter end and is adapted to receive the stem therein when the bristle aligning device is received on the bristles.

* * * * *